US006361481B1

(12) United States Patent
Koenig

(10) Patent No.: US 6,361,481 B1
(45) Date of Patent: Mar. 26, 2002

(54) WEIGHT LIFTING SIMULATOR

(75) Inventor: Larry D. Koenig, Williamsburg, IA (US)

(73) Assignee: Jam'n Fitness Corp., Altus, OK (US)

( * ) Notice: Subject to any disclaimer, the term of this patent is extended or adjusted under 35 U.S.C. 154(b) by 0 days.

(21) Appl. No.: 09/539,172

(22) Filed: Mar. 30, 2000

(51) Int. Cl.[7] ..... A63B 21/08
(52) U.S. Cl. ..... 482/97; 482/93; 482/94
(58) Field of Search ..... 482/92, 93, 95, 482/97–100, 104, 135–137, 133, 140, 145, 101, 94

(56) References Cited

U.S. PATENT DOCUMENTS 4,456,246 A * 6/1984 Szabo ..... 272/118
5,058,884 A * 10/1991 Fuller, Sr. ..... 272/117
5,151,071 A * 9/1992 Jain et al. ..... 482/101
5,529,558 A * 6/1996 Koenig ..... 482/97
5,688,216 A * 11/1997 Mauriello ..... 482/97
5,897,467 A * 4/1999 Habing et al. ..... 482/100

OTHER PUBLICATIONS

Advertising brochure, undated: , Hammer Strength, P.O. Box 19040, Cincinnati, OH 45219.
Advertising brochure, undated:, "Hammer Strength Product Information Guide", Hammer Strength, P.O. Box 19040, Cincinnati, OH 45219.
Advertising brochure, undated, "PTS Personal Training Systems", Pro Industries, 1015 N. Hurricane Rd. Franklin, IN 46131.
Hammer Strength Rowing/Seated Shrug, Hammer: First in Strength, Hammer Strength brochure, p. 11, circa 1994.

* cited by examiner

*Primary Examiner*—Justine R. Yu
(74) *Attorney, Agent, or Firm*—Allan L. Harms

(57) ABSTRACT

A weight lifting simulator exercises the hip girdle and shoulder girdle. A user standing on an inclined foot plate grabs a pair of handles which are free to swivel and raises a head member which slides along an upright mast which is slightly inclined toward the user positioned on the foot plate.

17 Claims, 5 Drawing Sheets

WEIGHT LIFTING SIMULATOR

BACKGROUND OF THE INVENTION

In the field of weight training, various exercises are performed with a barbell to provide additional loading of the body's muscles. In one exercise, an athlete rests a barbell on his or her shoulders and lowers to a squatting position and then rises to a standing position to strengthen leg muscles, in particular the hamstring group. In another exercise, a user may raise a barbell from the floor to a position at chest height in order to build arm and back muscle strength. Unfortunately the use of a barbell, especially carried on the shoulders, gives rise to instability with the user possibly experiencing a loss of balance. Therefore, what is needed is a weight lifting simulation device which permits the user to carry out the exercises of lifting weights while avoiding the instability of carrying a barbell or other free weights.

SUMMARY OF THE INVENTION

This invention provides a safe and effective strength building apparatus for strengthening the shoulder girdle and hip girdle muscles. The apparatus may be employed to carry out various exercises which might have been less safely done with a barbell or with dumbbells. A rectangular open base frame has a slightly inclined foot plate mounted within the frame adjacent its first end, the foot plate being highest at the first end of the base frame. At the opposite second end of the base frame there is an upright bar which is centered on the second end and serves to stabilize an inclined mast which is mounted to a cross member of the base frame. The mast is inclined slightly toward the foot plate at about five degrees from vertical. A pair of generally horizontal stabilizing bars join the top of the mast to the top of the upright bar. An inclined support braces the upright bar, the inclined support being mounted at one end to the upright bar and at the other end to the cross member of the base frame.

A head member is captured on the mast and may be freely moved along the mast. The head member includes opposing side plates which house roller bearings which roll along the mast. Extending from the head member at a fixed somewhat inclined angle are a pair of weight arms which have a horizontal weight rod transversely mounted to their free ends. The weight arms are inclined upward from the head member at about thirty-five degrees above horizontal to allow sufficient clearance for circular Olympic-style weight plates to be placed on the transverse weight rod when the head member is resting at the bottom of the mast.

On the end of the head member opposite the extending weight arms and facing the first end of the base frame there is a cross bar fixed to the edges of the side plates of the head member. Extending generally horizontally from the cross bar are a pair of handle assemblies which extend toward first end of the base frame and the foot plate. The handle assemblies are identical and each includes a lever which extends laterally rearward from the cross bar on the head member. The free end of each lever has a vertically oriented bearing housing which retains a curved handle to the lever such that the curved handle is free to rotate about the vertical axis of the bearing mount. Each of the curved handles is generally U-shaped and has a vertical stem which is retained in the bearing mount. The handle assemblies are spaced apart such that a user positioned on the foot plate facing the mast may squat with the knees between the handle assemblies. The user may grasp the handgrips while in a squatting position and rise to a standing position while raising the head member on the mast and then may continue to raise his or her arms and shoulders to raise the handgrips about chin high, whereupon the user may reverse the movements and return the head member to the bottom of the mast.

It is an object of the invention to provide a strength building apparatus which may be used to simulate the lifting of barbell or dumbbells.

It is a further object of the invention to provide a strength building apparatus which may be used without risk of loss of balance of the user when rising from a squatting position.

It is also an object of the invention to provide a strength building apparatus which permits strengthening exercise of the back, shoulder and arm muscles with less risk of back strain.

It is yet a further objection of the invention to provide a strength building apparatus which permits the user to lift a weight from a squatting position while keeping the spine straight and subjecting the hamstring and hip girdle muscles to bear the lifting effort.

It is still a further object of the invention to provide a weight lifting simulator which encourages strength building exercises while maintaining a proper posture to avoid back injury and strain.

These and other objects of the invention will be understood from review of the drawings and the detailed description which follows.

DESCRIPTION OF THE DRAWING FIGURE

DETAILED DESCRIPTION OF THE INVENTION

Figure 1:
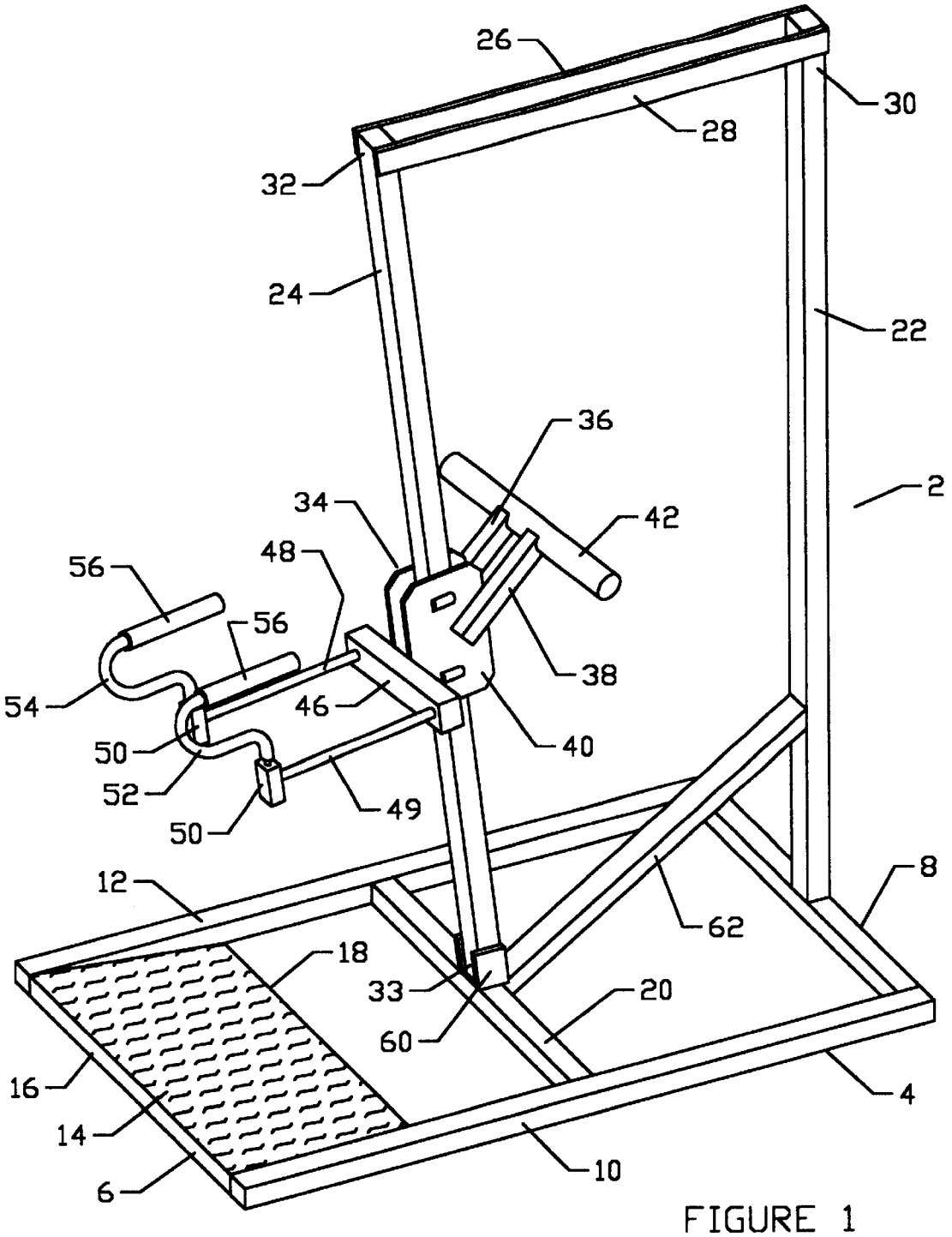
FIG. 1 is a perspective of the weight lifting simulator invention with the head member raised part away along the mast.

Referring to the figures, the preferred embodiment of the weight lifting simulator 2 is shown. An open frame 4 serves as a base for the weight lifting simulator 2 and comprises a user station end 6 and an opposing second end 8 with sides 10, 12 interconnecting user station end 6 and opposing second end 8. A cross member 20 interconnects sides 10, 12 generally midway along the length of frame 4. A foot plate 14 is mounted between sides 10, 12 adjacent user station end 6, the foot plate 14 being inclined slightly such that the rear edge 16 is higher than forward edge 18 thereof. Rear edge 16 of foot plate 14 overlies user station end 6 and is mounted thereupon.

Mounted generally centrally along cross member 20 is mast 24 which upstands on cross member 20 and extends at a slight angle from vertical toward user station end 6. Mast 24 is sufficiently elongate such that it extends above the height of an anticipated user. An upright bar 22 stands fixed upon opposing second end 8 of frame 4 generally on the longitudinal axis of frame 4, aligned with mast 22. An inclined brace 62 extends between cross member 20 and upright bar 22. A pair of lateral stabilizers 26, 28 join the upper end 30 of upright bar 22 to the top end 32 of mast 24 to retain mast 24 in its inclined position.

Mounted at lower end 33 of mast 24 is at least one stop 60 disposed adjacent mast 24 such that head assembly 34 may rest on stop 60 when the weight lifting simulator 2 is at rest.

Head assembly 34 of the preferred embodiment comprise a head member 40 which is retained to mast 24 is freely slidable therealong. Head assembly 34 further comprises paired weight arms 36 and 38 which are fixed to opposing side plates 64, 66 of head member 40 and extend from head member 40 at an incline toward upright bar 22. At the free ends of weight arms 36 and 38 is fixed a transverse weight receiving rod 42 which is disposed substantially horizontally and is preferably sized to receive a circular free weights thereon according to the desired loading of the weight lifting simulator 2. Weight rod 42 is mounted generally symmetrically upon the free ends of weight arms 36, 38.

Fixably mounted to head member 40 at the side thereof opposing upright member 22 is a cross bar 46 which is oriented horizontally and supports a pair of handle levers 48, 49 which are spaced apart and generally parallel, which each extending toward user station end 6 from its mounting to cross bar 46. Each handle lever 48, 49 has a bearing mount 50 at its free end, the bearing mounts 50 oriented to support handles 52 and 54 such that handles 52, 54 may freely swivel about a generally vertical axis. Each handle 52, 54 is identical and is provided with a hand grip 56 intended for grasping by a user stationed on foot plate 14.

Figure 2:
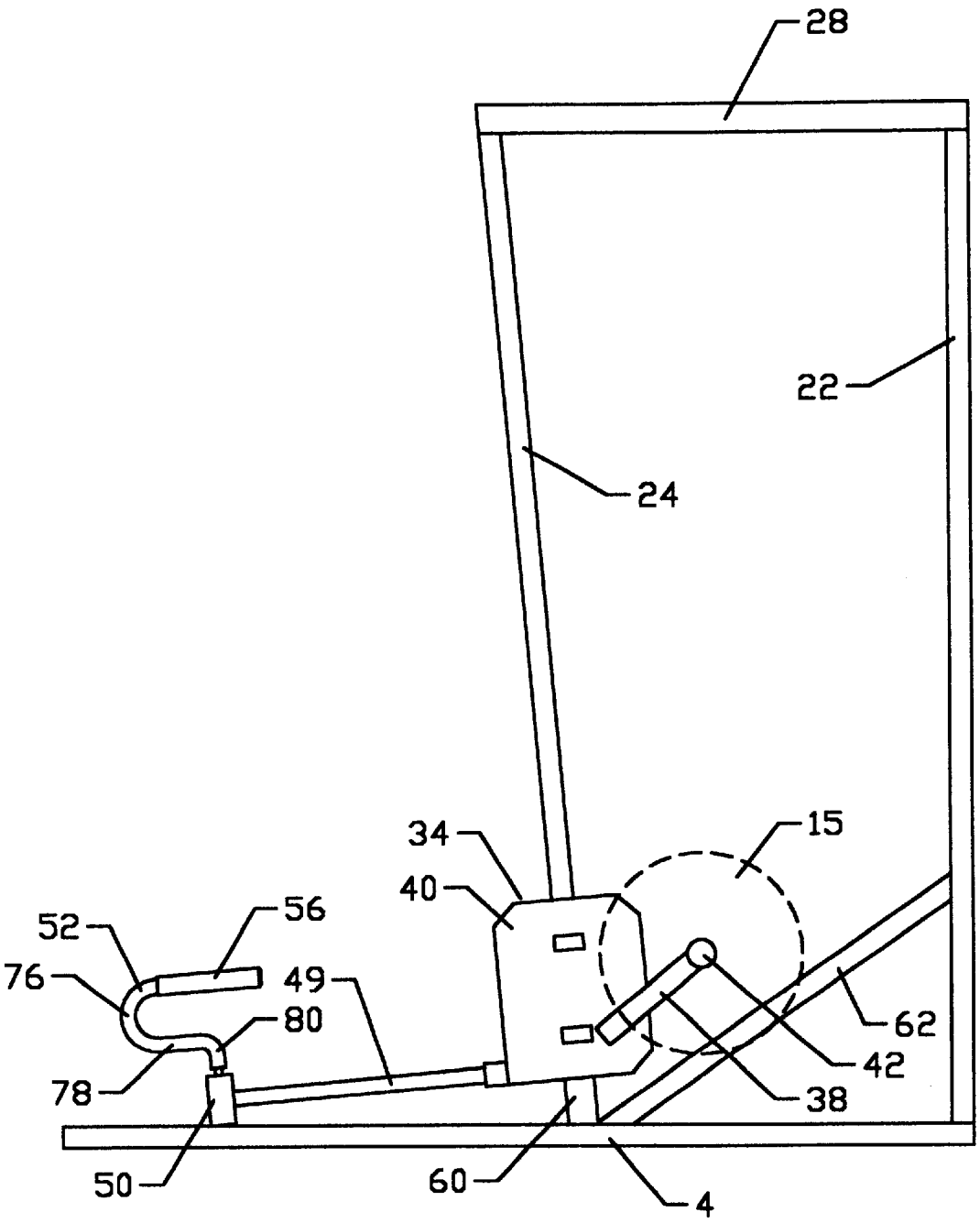
FIG. 2 is a front elevation of the invention with the head resting on a stop at the bottom of the mast.

Referring in particular to FIG. 2 it can be understood that when invention 2 is at rest, the head member 40 will rest on stop 60 at the bottom of mast 24. In this position, free weights 15 shown by dashed lines can be selectively suspended upon weight rod 42. The angle of inclination of weight arms 36, 38 is selected at about forty five degrees to allow clearance for the largest circular weight plates 15 while head assembly 34 is at its lower most position.

FIG. 2 illustrates that handles 52, 54 are generally U-shaped with hand grip 56 disposed substantially horizontally and joined by a curved segment 76 to lower horizontal segment 78 which is joined to stem 80. Stem 80 is provided with an axially depending pin which is received and retained against vertical displacement by bearing mount 50.

Handle levers 48, 49 from generally a perpendicular to the axis of mast 24 and extend sufficiently from head member 40 to allow free rotation of handles 52, 54.

Figure 3:
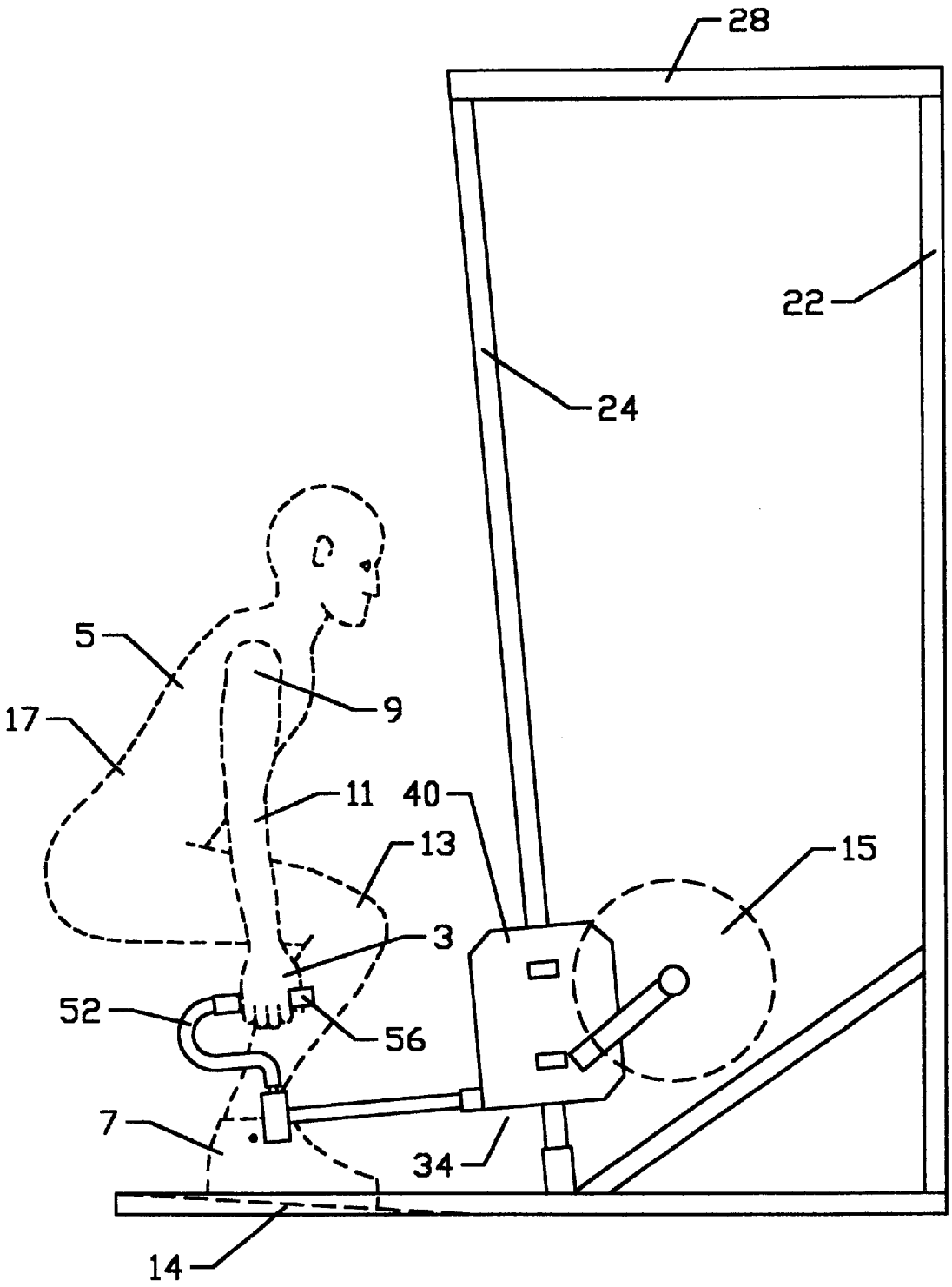
FIG. 3 is a front elevation of the invention shown with the head assembly being lifted by a user shown in dashed lines positioned on the foot plate of the invention in a squatting position.

FIG. 3 illustrates use of the invention 2 to strengthen the hamstring muscles and other hip and leg muscles of the user 5. The user 5 has assumed a crouched or squatting position with the user's feet 7 on foot plate 14. The user 5 has grasp handles 52, 54 with user's hands 3 while standing with knees 13 bent and positioned between handles 52, 54. Handle grips 56 are oriented in axial alignment with the longitudinal axis of invention 2 such that user 5 may grasp handle grips 56 with the user's hands generally vertically aligned with the user's shoulders 9, with the arms 11 straight. In this position, with the user's back 17 straight, a safe lift of head assembly 34 may be made from the user's squatting position. As the user 5 lifts head assembly 34, head member 40 rides along mast 24 along a path which permits user to rise to a standing position without straining the back. In contrast, a user attempting to lift a barbell out in front of the knees cannot do this while keeping the back straight.

Figure 4:
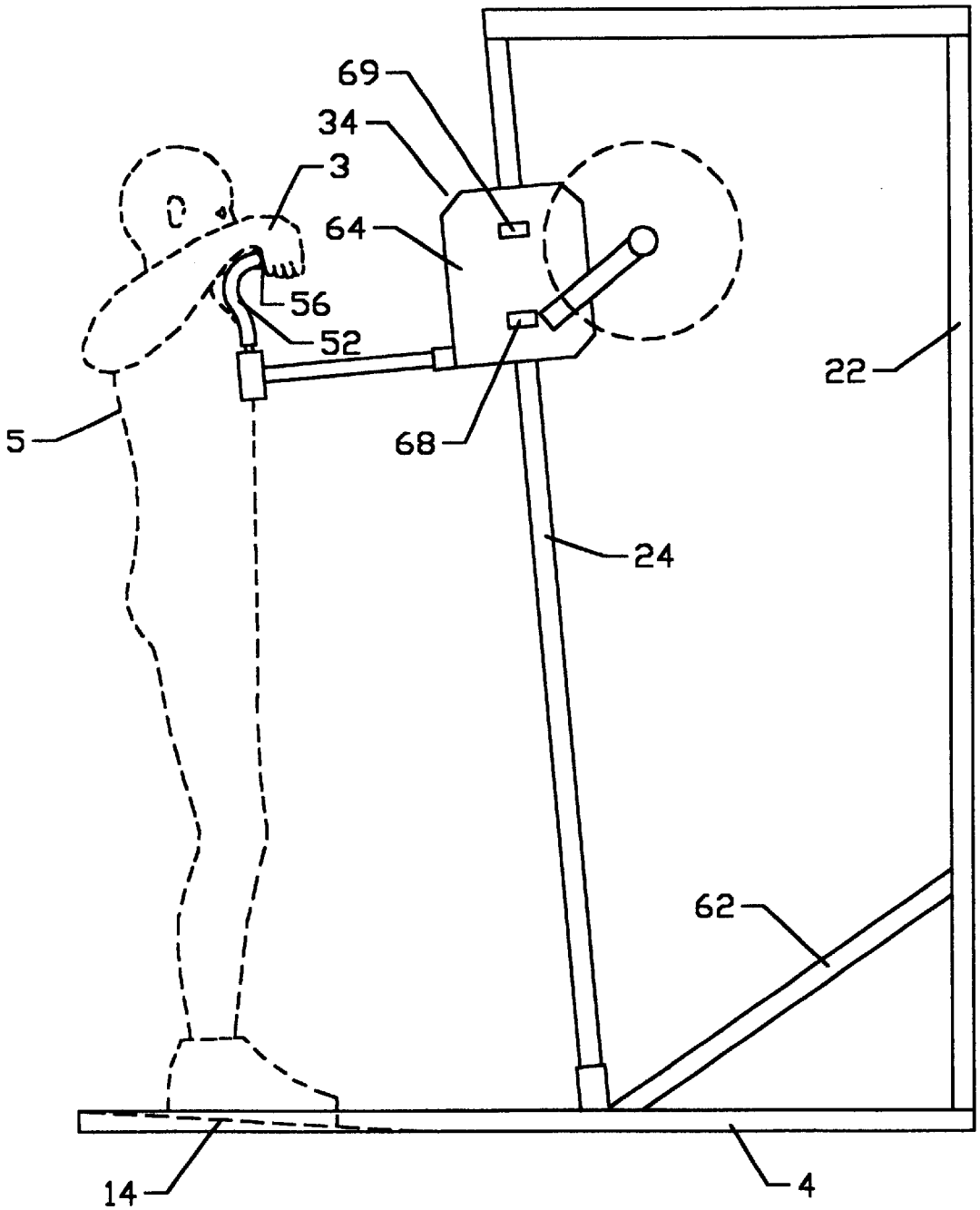
FIG. 4 is a front elevation of the invention shown with the head assembly lifted to the height of the chin of the user.

FIG. 4 illustrates the use of invention 2 after the user 5 has reached a standing position and continues to raise the arms 11 and hands 3 to lift handle grip 56 to about the height of the user's chin. As the head assembly 34 is raised along mast 24, the handles 52, 54 may rotate so that the user's hands 3 may move to a comfortable position as the head assembly 34 is raised. As head member 40 moves along mast 24, roller bearings 68, 69 support side plate 64 of head member 40 at a spacing from mast 24.

Figure 5:
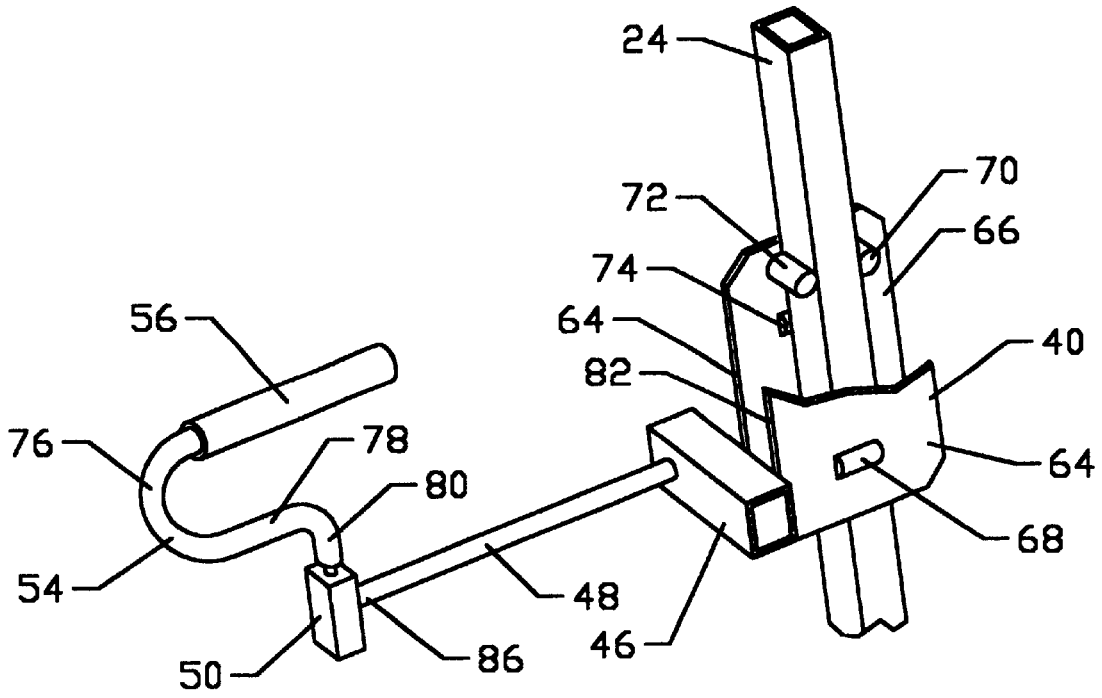
FIG. 5 is a close up view with parts cut away of the head assembly of the invention.

The details of the structure of head member 40 can be visualized in FIG. 5. Head member 40 comprises first side plate 64 and opposing second side plate 66, each of which is disposed at opposing sides of mast 24. Side plates 64, 66 house vertically spaced lateral roller bearings 68 and 74 (corresponding opposing lateral roller bearings are not shown in FIG. 5) such that roller bearings 68, 74 may roll along the sides of mast 24. Front and rear roller bearings 70, 72 are disposed between side plates 64, 66, the ends of which are retained to side plates 64, 66 to provide bearing support on the front and rear sides of mast 24. (A second pair of front and rear bearings is disposed at a lower position between side plates 64, 66 but cannot be seen in FIG. 5). Cross bar 46 is fixed to the vertical side edges 82, 84 of side plates 64, 66 respectively which face user 5, at the lower ends of edges 82, 84.

Lever 48 extends substantially perpendicularly from cross bar 46 and supports bearing mount 50 at its free end 86. Stem 80 of handle 54 extends generally vertically into bearing mount 50 such that handle 54 may rotate freely about the generally vertical axis of stem 80. Curved segment 76 of handle 54 joins lower horizontal segment 78 to hand grip 56 which vertically overlies lower horizontal segment 78. The handle 54 is thereby shaped to allow user a user grasping hand grip 56 to move the handle into a comfortable rotational orientation as the head member 40 is raised along mast 24.

Having described the invention, I claim:

1. Exercise apparatus for the hip and shoulder girdle comprising a base frame having a first end and a second end and a cross member intermediate said first end and said second end, said frame supporting a foot plate thereon adjacent said first end thereof, a mast upstandingly fixed to said cross member, said mast inclined slightly from vertical toward said first end, said mast having a head member freely slidable therealong, said head member comprising a weight arm extending therefrom toward said second end of said frame, said arm selectively receiving weight thereon, at least one handle assembly extending toward said foot plate from said head member, said at least one handle assembly including a handle freely rotatable about a generally vertical axis, said handle including a hand grip oriented generally horizontally whereby a user facing said mast while crouched upon said foot plate may grasp said hand grip and raise said head member along said mast.

2. The exercise apparatus of claim 1 wherein, said foot plate is inclined toward said first end of said frame.

3. The exercise apparatus of claim 1 wherein, said head member has a second handle assembly extending therefrom, said second handle assembly laterally spaced apart from said at least one handle assembly, said second handle assembly including a second handle freely rotatable about a generally vertical axis, said second handle having a generally horizontally oriented hand grip.

4. The exercise apparatus of claim 3 wherein, said handle members are spaced apart sufficiently to permit placement of a user's knees therebetween.

5. The exercise apparatus of claim 4 wherein, said foot plate is slowed downward away from said first end of said frame, said foot plate having a lower end underlying said handle members.

6. The exercise apparatus of claim 3 wherein, each of said handle members spaced from said head member by a laterally extending lever.

7. The exercise apparatus of claim 1 wherein, said head member comprises a pair of spaced apart, vertically oriented side plates, each of said side plates adjacent an opposing side of said mast, said side plates retaining at least one roller bearing therebetween, said at least one roller bearing touchingly engaging said mast.

8. The exercise apparatus of claim 7 wherein, said head member comprises a first pair of roller bearings supported between said side plates, a second pair of roller bearings retained to said side plates, each of said roller bearings touchingly engagable with said mast.

9. A weight lifting simulator comprising a base having an upstanding mast rigidly fixed thereto and generally centered thereon, the upstanding mast inclining slightly from vertical, said upstanding mast having a longitudinal axis, a head member slidable along said mast, the head member comprising an elongate weight arm fixed thereto, the weight arm having a free end, said weight arm extending from said head member in a first direction, a grasping assembly extending from said head member in a second direction, the grasping assembly including at least one handle which can be grasped by a user, and said mast slightly inclining toward said second direction.

10. Exercise apparatus for the hip and shoulder girdle comprising a base having a first end and a second end, an elongate mast upstandingly rigidly fixed to said base intermediately therealong, said mast inclined slightly from vertical toward said first end of said base, said mast having a head member freely slidable therealong, said head member comprising a weight arm rigidly fixed thereto, said weight arm having a free end, said weight arm extending from said head member toward said second end of said base, said weight arm selectively receiving weight thereon, at least one handle assembly fixed to said head member and extending toward said first end of said base.

11. The exercise apparatus of claim 10 wherein said at least one handle assembly including a handle freely rotatable about an axis generally parallel to said mast, said handle including a hand grip oriented generally horizontally whereby a user facing said mast may grasp said hand grip and raise said head member along said mast.

12. The exercise apparatus of claim 11 wherein a foot plate is fixed to said base adjacent the first end thereof, said foot plate having a front edge and a rear edge, said rear edge adjacent the first end of said base, said front edge lower than said rear edge.

13. A The exercise apparatus of claim 12 wherein a second handle assembly is fixed to said head member, said second handle assembly extending toward said first end, said second handle assembly having a handle freely rotatable thereupon.

14. The exercise apparatus of claim 13 wherein said head member comprises a pair of spaced apart plates joined by at least one pair of rollers, each of said at least one pair of rollers touchingly engaging said mast.

15. The exercise apparatus of claim 14 wherein each of said handle assemblies extending over said foot plate, each of said handles having a handgrip thereon, each of said handgrips oriented generally horizontally.

16. The exercise apparatus of claim 15 wherein said base includes an upstanding post rigidly mounted to said second end thereof, at least one bar interconnects said post and said mast.

17. The exercise apparatus of claim 16 wherein said weight arm has a free end and an opposing fixed end fixed to said head member, said weight arm inclines upwardly from the fixed end thereof, a transverse rod mounted at said free end of said weight arm, said transverse rod selectively receiving free weight plates thereon, said mast having an upper end, said post having an upper end, said at least one bar interconnecting said upper end of said mast to said upper end of said post.

* * * * *

UNITED STATES PATENT AND TRADEMARK OFFICE

CERTIFICATE OF CORRECTION

PATENT NO. : 6,361,481 B1
DATED : March 26, 2002
INVENTOR(S) : Larry D. Koenig

It is certified that error appears in the above-identified patent and that said Letters Patent is hereby corrected as shown below:

Column 5,
Line 7, delete "slowed" and substitute therefor -- sloped --.

Column 6,
Line 20, delete "A".

Signed and Sealed this

Eighteenth Day of June, 2002

*Attest:*

*Attesting Officer*

JAMES E. ROGAN
*Director of the United States Patent and Trademark Office*